US008162309B2

(12) United States Patent
Kawamata et al.

(10) Patent No.: US 8,162,309 B2
(45) Date of Patent: Apr. 24, 2012

(54) SHEET CONVEYING DEVICE AND IMAGE RECORDING APPARATUS COMPRISING SHEET CONVEYING DEVICE

(75) Inventors: Noriyuki Kawamata, Nagoya (JP); Takashi Ohama, Iwakura (JP); Wataru Sugiyama, Aichi-ken (JP); Yuta Uchino, Nagoya (JP); Tsuyoshi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 52 days.

(21) Appl. No.: 12/749,052

(22) Filed: Mar. 29, 2010

(65) Prior Publication Data

US 2010/0244362 A1 Sep. 30, 2010

(30) Foreign Application Priority Data

Mar. 30, 2009 (JP) ..... 2009-081464

(51) Int. Cl.
*B65H 5/00* (2006.01)
*B65H 7/02* (2006.01)

(52) U.S. Cl. ..... 271/10.03; 271/225; 271/902; 271/227; 271/4.04

(58) Field of Classification Search ..... 271/10.03, 271/227, 228, 242, 902, 244, 246, 225
See application file for complete search history.

(56) References Cited

U.S. PATENT DOCUMENTS

| | | | | |
|---|---|---|---|---|
| 5,417,415 | A * | 5/1995 | Murakami | 271/227 |
| 5,779,234 | A * | 7/1998 | Tomii et al. | 271/3.2 |
| 6,092,803 | A * | 7/2000 | Munenaka | 271/242 |
| 7,887,044 | B2 * | 2/2011 | Uchino et al. | 271/121 |

FOREIGN PATENT DOCUMENTS

| | | | |
|---|---|---|---|
| JP | 62259944 | A * | 11/1987 |
| JP | H05-186102 | A | 7/1993 |
| JP | 2000-318880 | A | 11/2000 |
| JP | 2008-100833 | A | 5/2008 |

OTHER PUBLICATIONS

Japan Patent Office; Notice of Reasons for Rejection for Patent Application No. 2009-081464, mailed Jan. 25, 2011. (counterpart to above-captioned U.S. patent application) (partial translation).

* cited by examiner

*Primary Examiner* — Michael McCullough
*Assistant Examiner* — Luis A Gonzalez
(74) *Attorney, Agent, or Firm* — Baker Botts L.L.P.

(57) ABSTRACT

A first convey roller conveys a sheet in a sheet conveying direction such that a leading edge of the sheet passes through a nip of a second convey roller disposed downstream from the first convey roller. The second convey roller rotates in a reverse direction by a first rotation amount corresponding to a first linear distance to convey the sheet in a direction opposite to the sheet conveying direction, such that the leading edge of the sheet is released from the nip of the second convey roller. In response to the rotation of the second convey roller in the reverse direction, the first convey roller rotates by a second rotation amount corresponding to a second linear distance in the reverse direction to convey the sheet in the direction opposite to the sheet conveying direction, such that the leading edge of the sheet contacts the nip of the second convey roller when the first convey roller has rotated by the second rotation amount and the second convey roller has rotated by the first rotation amount.

14 Claims, 8 Drawing Sheets

SHEET CONVEYING DEVICE AND IMAGE RECORDING APPARATUS COMPRISING SHEET CONVEYING DEVICE

CROSS REFERENCE TO RELATED APPLICATION

This application claims priority from Japanese Patent Application No. 2009-081464, which was filed on Mar. 30, 2009, the disclosure of which is incorporated herein by reference in its entirety.

BACKGROUND OF THE INVENTION

1. Field of the Invention

This application relates to a sheet conveying device configured to perform registration of a sheet and to correct or reduce skewing of the sheet.

2. Description of Related Art

A known sheet conveying device is configured to feed a sheet from a feed tray and to convey the sheet to a recording unit along a sheet conveying path. The known sheet conveying device comprises a first convey roller and a second convey roller disposed along the sheet conveying path. The second convey roller is disposed downstream from the first convey roller and upstream from the recording unit. In order to perform registration of a sheet, the first convey roller is rotated in a forward direction to convey the sheet fed from the feed tray until the second convey roller nips the sheet. Subsequently, while the first convey roller is stopped, the second convey roller is rotated in a reverse direction to convey the sheet reversely until the sheet is released from a nip of the second convey roller. The sheet is bent between the first convey roller and the second convey roller, and an edge of the sheet is aligned with respect to the second convey roller.

However, the sheet may not be released from the nip of the second convey roller depending on a characteristic of a sheet. When a sheet having a particular characteristic is conveyed reversely by the second convey roller while the first convey roller is stopped, the sheet is bent and may generate a resilient force greater than a nip force of the second convey roller, and the second convey roller rotated in the reverse direction may slip on the sheet. This may impair alignment and deskewing of the sheet, and may cause damage to the sheet.

SUMMARY OF THE INVENTION

Therefore, a need has arisen for a sheet conveying device that overcomes these and other shortcomings of the related art. A technical advantage of the invention is that sheet registration is performed stably and properly according to a characteristic of a sheet, and thereby skewing of the sheet is corrected or reduced.

According to an embodiment of the invention, a sheet conveying device comprises a first convey roller disposed in a first path, a second convey roller disposed in the first path downstream from the first convey roller in a sheet conveying direction in the first path, a driving unit configured to independently drive each of the first convey roller and the second convey roller, and a controller. The controller is configured to control the driving unit in a particular mode in the following manner. The first convey roller rotates in a forward direction to convey a sheet along the first path in the sheet conveying direction. The second convey roller rotates in a forward direction to convey the sheet along the first path in the sheet conveying direction, wherein the first convey roller conveys the sheet such that a leading edge of the sheet passes through a nip of the second convey roller. The second convey roller rotates in a reverse direction by a first rotation amount corresponding to a first linear distance to convey the sheet in a direction opposite to the sheet conveying direction, such that the leading edge of the sheet is released from the nip of the second convey roller. In response to the rotation of the second convey roller in the reverse direction, the first convey roller rotates by a second rotation amount corresponding to a second linear distance in the reverse direction to convey the sheet in the direction opposite to the sheet conveying direction, such that the leading edge of the sheet contacts the nip of the second convey roller when the first convey roller has rotated by the second rotation amount and the second convey roller has rotated by the first rotation amount.

According to another embodiment of the invention, an image recording apparatus comprises a recording unit configured to record an image on a sheet conveyed along a first path in a sheet conveying direction, a first convey roller disposed in the first path, a second convey roller disposed in the first path downstream from the first convey roller and upstream from the recording unit in the sheet conveying direction, a driving unit configured to independently drive each of the first convey roller and the second convey roller; and a controller. The controller is configured to control the driving unit in a particular mode in the following manner. The first convey roller rotates in a forward direction to convey a sheet along the first path in the sheet conveying direction. The second convey roller rotates in a forward direction to convey the sheet along the first path in the sheet conveying direction, wherein the first convey roller conveys the sheet such that a leading edge of the sheet passes through a nip of the second convey roller. The second convey roller rotates in a reverse direction by a first rotation amount corresponding to a first linear distance to convey the sheet in a direction opposite to the sheet conveying direction, such that the leading edge of the sheet is released from the nip of the second convey roller. In response to the rotation of the second convey roller in the reverse direction, the first convey roller rotates by a second rotation amount corresponding to a second linear distance to convey the sheet in the reverse direction opposite to the sheet conveying direction, such that the leading edge of the sheet contacts the nip of the second convey roller when the first convey roller has rotated by the second rotation amount and the second convey roller has rotated by the first rotation amount.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-8, like numerals being used for like corresponding parts in the various drawings.

Figure 1:
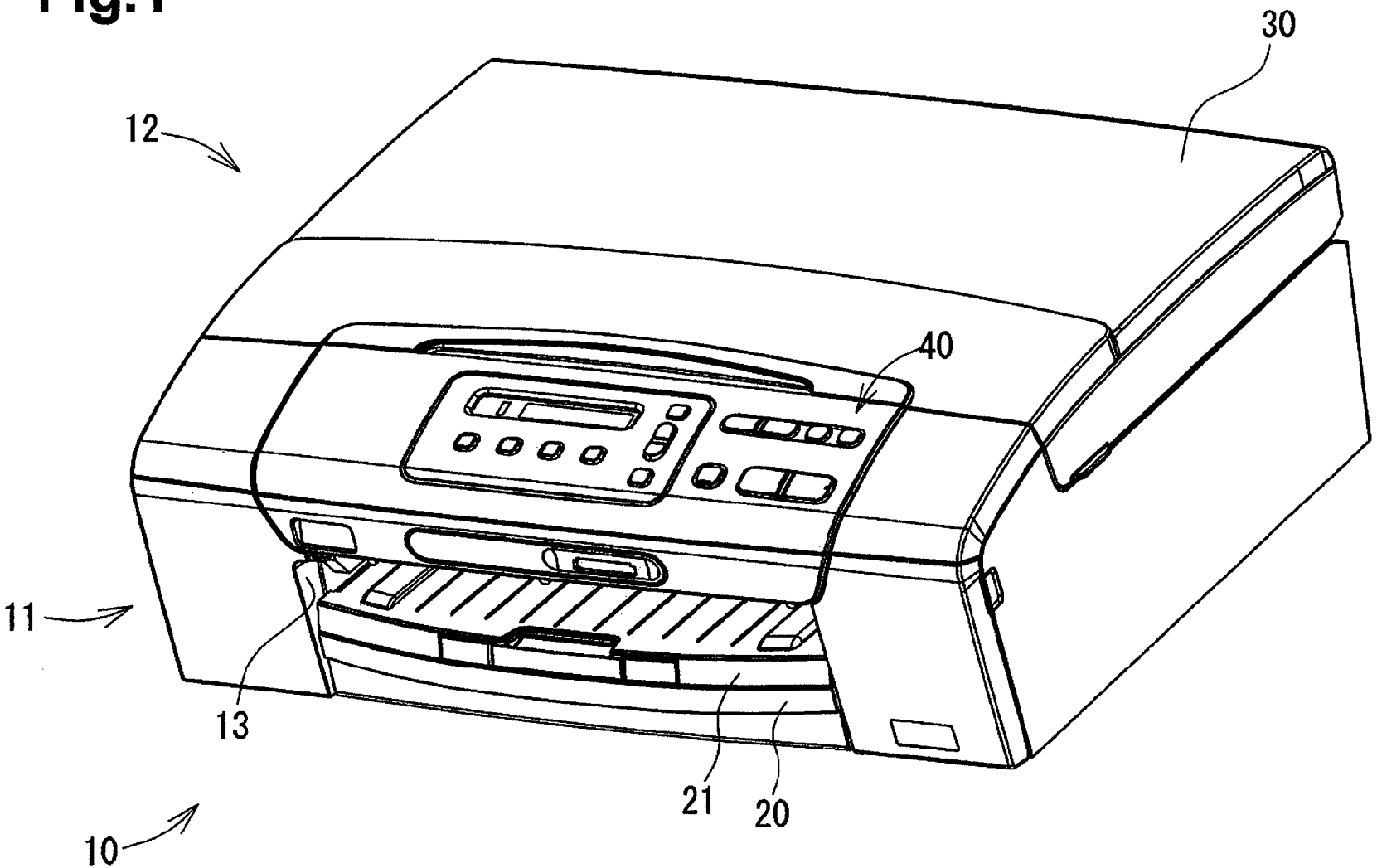
FIG. 1 is a perspective view of an image recording apparatus, e.g., a multi-function device, according to an embodiment of the invention.

As shown in FIG. 1, an image recording apparatus, e.g., a multi-function device 10 may perform one or more functions, e.g., printing, coping, scanning, facsimile functions, or any combination thereof. The image recording apparatus may perform single-sided recording and/or double-sided recording.

The multi-function device 10 comprises a printer 11 disposed at the bottom, a scanner 12 disposed at the top, and an operation panel 40 disposed at the front top of the device 10. The printer 11 may record an image by inkjet method on a first side (front side) and a second side (back side) of a recording medium, e.g., a sheet.

The printer 11 has an opening 13 at the front of the multi-function device 10. A feed tray 20 and a discharge tray 21 are arranged in two layers vertically in the opening 13. Sheets staked in the feed tray 20 is conveyed to the printer 11, and a sheet having an image recorded thereon is discharged onto the discharge tray 21. The feed tray 20 and the discharge tray 21 are detachably inserted into the printer 11 through the opening 13.

The scanner 12 may be a flatbed scanner. A document cover 30 is disposed at the top of the scanner 12 and serves as a top plate of the multi-function device 10. A platen glass (not shown) is disposed under the document cover 30. The scanner 12 reads a document placed on the platen glass and covered by the document cover 30.

The operation panel 40 for operating the printer 11 and the scanner 12 comprises operation buttons and a liquid crystal display. The operation panel 40 allows a user to perform various settings and operations, e.g., designating a characteristic of a sheet, setting a printing mode (single-sided recording mode or double-sided recording mode), and setting a resolution (draft mode or photo mode).

Figure 2:
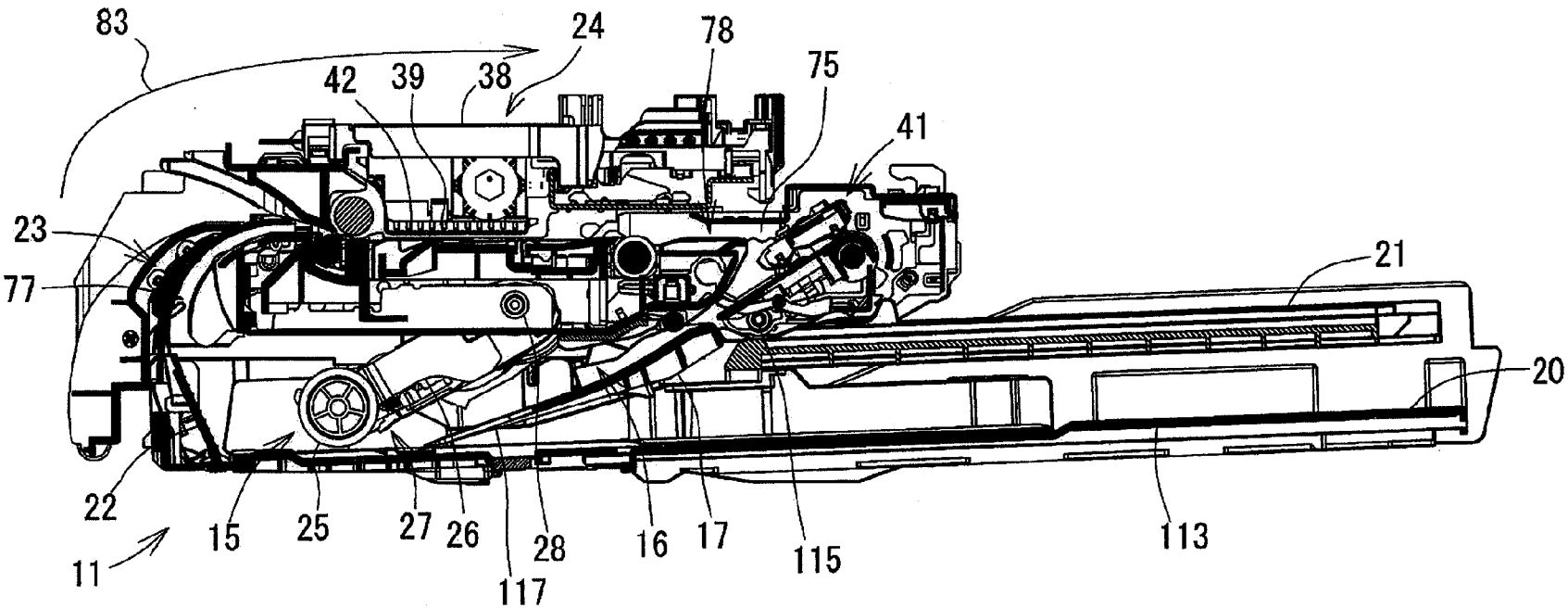
FIG. 2 is a vertical cross-sectional view of a printer of the image recording apparatus of FIG. 1, according to an embodiment of the invention.
Figure 3:
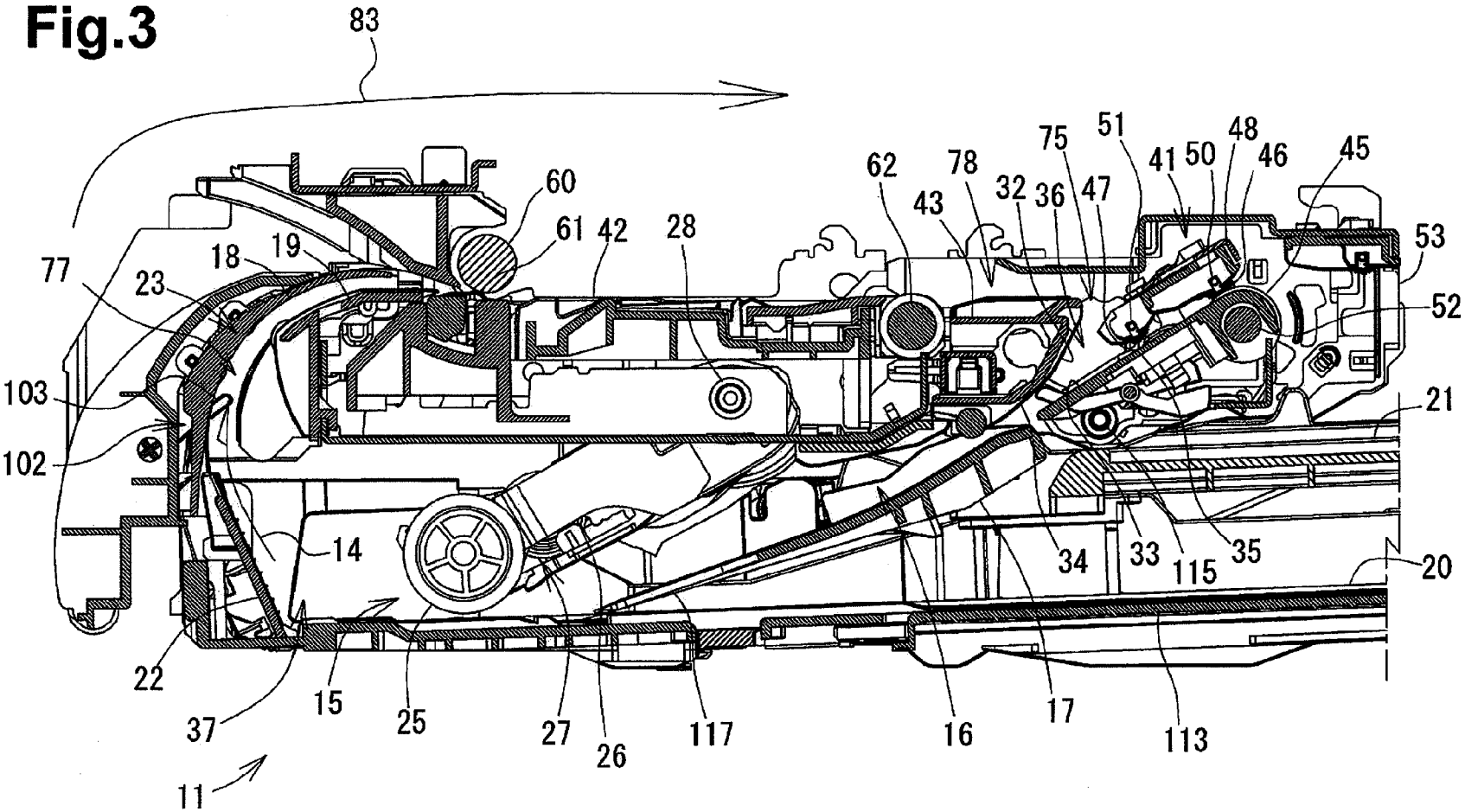
FIG. 3 is a partial enlarged vertical cross-sectional view of the printer of FIG. 2.
Figure 4A:
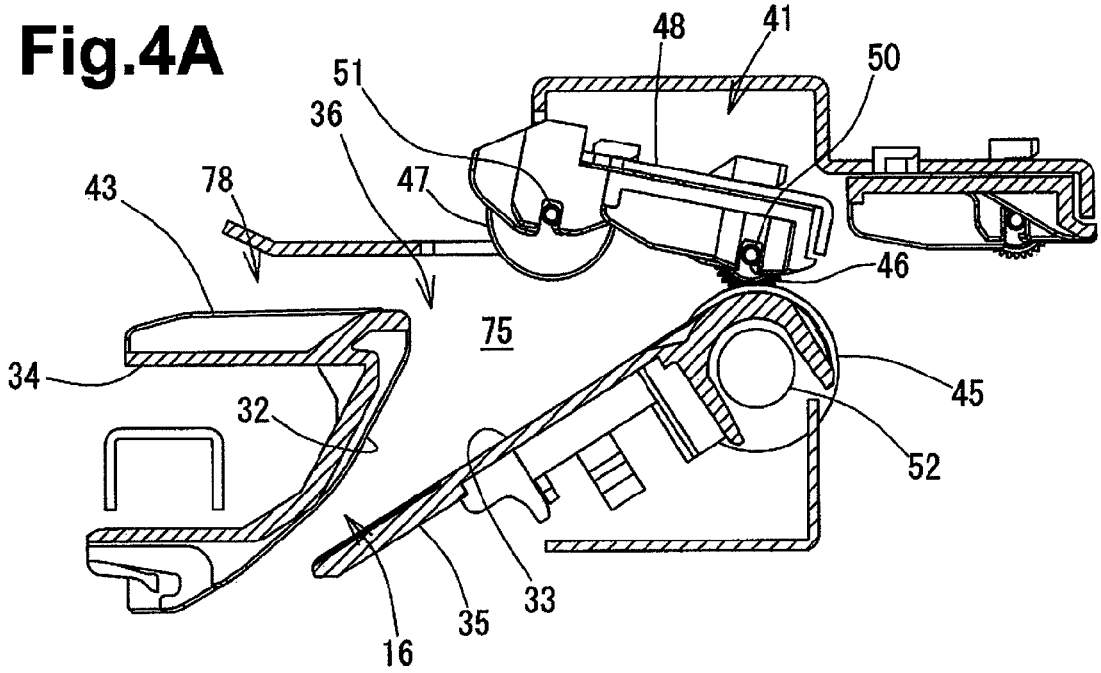
FIGS. 4A and 4B are enlarged cross-sectional views showing a path switching unit and its surroundings of the printer of FIG. 3, according to an embodiment of the invention.
Figure 4B:
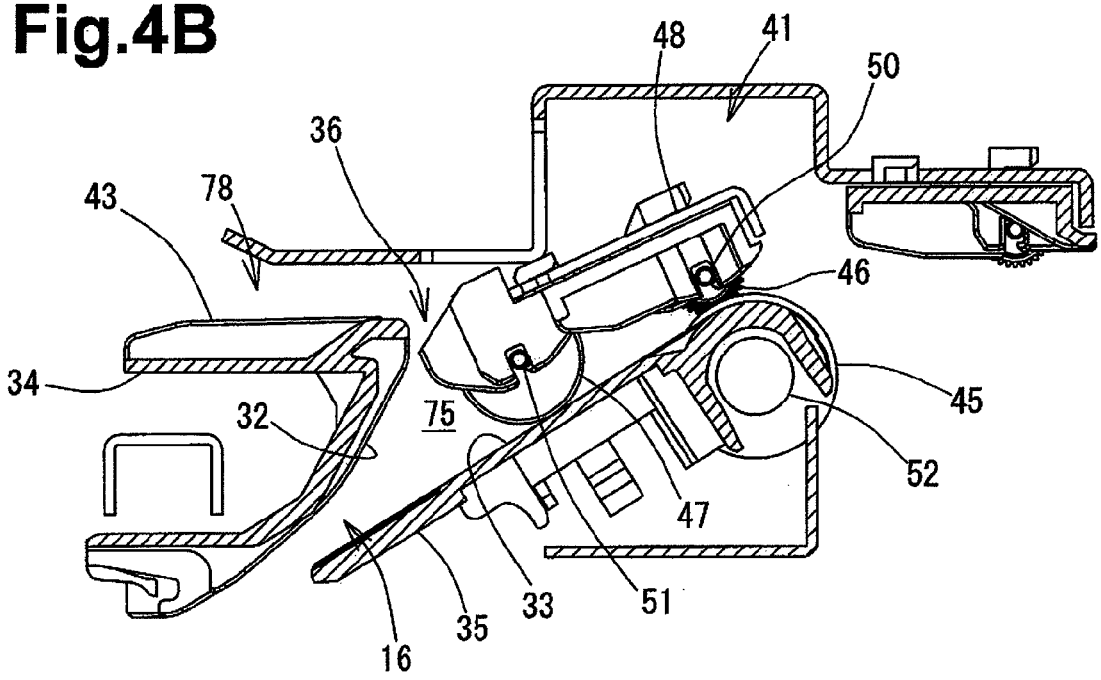

As shown in FIG. 2, the printer 11 comprises the feed tray 20, a sheet feeder 15, a recording unit 24, the discharge tray 21, and a path switching unit 41. The sheet fed by the sheet feeder 15 is conveyed in a first conveying direction along a first conveying path 23 to the recording unit 24. The sheet having an image recorded thereon is discharged onto the discharge tray 21. The path switching unit 41 is disposed between the recording unit 24 and the discharge tray 21 along the first conveying path 23 and defines a branch port 75, and is configured to selectively guide a sheet having an image recorded thereon to the discharge tray 21 along the first conveying path 23 or back to the feed tray 20 along a second conveying path, e.g., a reverse path 16.

The recording unit 24 ejects ink onto a sheet conveyed along the first conveying path 23 to record an image thereon. When the recording unit 24 records an image on a first side (front side) of a sheet, the sheet is conveyed along the first conveying path 23 with its first edge as a leading edge. When the recording unit 24 records an image on a second side (back side) of the sheet, the sheet is switchbacked along the reverse path 16 and is conveyed along the first conveying path 23 with its first edge as a trailing edge, i.e., with its second edge as a leading edge. The path switching unit 41 guides the sheet having an image thereon from the branch port 75 to the feed tray 20 along the reverse path 16, which bypasses the recording unit 24. The feed roller 25 feeds again the returned sheet to the convey roller 60 along the first conveying path 23 with its second edge as a leading edge.

The feed tray 20 is disposed under the sheet feeder 15 and at the bottom of the printer 11. The feed tray 20 is box-shaped and open upward, and comprises a bottom plate 113 for holding a stack of sheets. The sheet feeder 15 comprises a feed roller 25 configured to feed a sheet from the feed tray 20 along the first conveying path 23. The feed roller 25 functions as a first convey roller. The discharge tray 21 is disposed above the feed tray 20. A flap 17 is attached to an end (left end in FIG. 2) of the discharge tray 21. The flap 17 and guide members 34, 35 define the reverse path 16.

In the single-sided recording mode, a sheet fed by the feed roller 25 is U-turned upward along the first conveying path 32 to the recording unit 24. The sheet having an image recorded on a first side (front side) is discharged onto the discharge tray 21. In the double-sided recording mode, the switching unit 41 guides a sheet having an image recorded on a first side (front side) to the feed tray 20, along the reverse path 16, with its second edge as a leading edge. The feed roller 25 feeds the sheet again along the first conveying path 23. The sheet is U-turned along the first conveying path 23, and the recording unit 24 records an image on a second side (back side) of the sheet. Then, the sheet is discharged onto the discharged tray 21.

The recording unit 24 is disposed along the first conveying path 23 and comprises a carriage 38 and a recording head 39. The recording head 39 is mounted on the carriage 38 with a nozzle face exposed to the first conveying path 23. When the carriage reciprocates, together with the recording head 39, along a guide rail in a main scanning direction, e.g., a direction perpendicular to a sheet plane of FIG. 2, the recording head 39 ejects droplets of ink onto a sheet conveyed on a platen 42 (FIG. 3) to form an image on the sheet. Ink is supplied from an ink cartridge (not shown). The recording unit 24 is omitted from FIG. 3.

The sheet feeder 15 comprises the feed roller 25, a feed arm 26, and a transmitting mechanism 27. The feed roller 25 is supported rotatably at a distal end of the feed arm 26. The feed arm 26 is configured to pivot about its base end, and the feed roller 25 is urged to contact an uppermost one of the sheets in the feed tray 20. The feed roller 25 is rotated by a sheet feed motor 74 via the transmitting mechanism 27, e.g., gears arranged substantially linearly. The sheet feed motor 74 may be a DC motor.

A rotary encoder 86 is attached to the feed roller 25. An optical sensor of the rotary encoder 86 detects a pattern of an encoder disc which rotates with the feed roller 25. Based on a signal output by the optical sensor, the controller 84 determines the rotation amount of the feed roller 25 and controls the rotation of the feed roller 25.

The feed arm 26 is supported, at its base end, on a shaft 28 so as to pivot about the shaft 28. The feed arm 26 moves vertically toward and away from the feed tray 20. The feed arm 26 is biased by its own weight or by a spring, or by both, to pivot downward. Thus, the feed roller 25 contacts the sheets in the feed tray 20, or the bottom plate 113 when there is no sheet in the feed tray 20. The feed arm 26 is configured to move up away from the feed tray 20 when the feed tray 20 is inserted into and removed from the printer 11.

In order to feed the sheets from the feed tray 20, the feed roller 25 rotates while pressing the sheets in the feed tray 20. An uppermost one of the sheets is fed along the first conveying path 23 in the first conveying direction (leftward in FIG. 3) due to friction generated between the feed roller 25 and the uppermost sheet.

When a leading edge of the uppermost sheet contacts an inclined separation plate 22 disposed on the feed tray 20, the uppermost sheet is guided upward in a direction indicated by arrow 14 and fed along the first conveying path 23. The inclined separation plate 22 prevents a sheet immediately under the uppermost sheet from being fed together due to friction and static electricity.

The first conveying path 23 comprises a curved path 77 extending from the inclined separation plate 22 to the recording unit 24, and a discharging path 78 extending from the recording unit 24 to the discharge tray 21. The curved path 77 extends along the inclined separation plate 22 upward and curves in the U-shape toward the front of the multi-function device 10 (rightward in FIG. 3), and reaches the recording unit 24. The feed roller 25 feeds the uppermost sheet from the feed tray 20 while contacting one side of the uppermost sheet, and the uppermost sheet is conveyed along the first conveying path 23 such that the other side of the uppermost sheet faces the recording unit 24. The discharging path 78 extends substantially linearly from the recording unit 24 toward the front of the multi-function device 20 and reaches the discharge tray 21.

The curved path 77 is defined, at the rear of the multi-function device 10, by an outer guide member 18 and an inner guide member 19. The outer guide member 18 and the inner guide member 19 are coupled to a main body frame 53 so as to oppose to each other with a predetermined interval left therebetween.

A convey roller 60, which functions as a second convey roller, and a pinch roller 61 are disposed upstream from the recording unit 24 along the first conveying path 23. The pinch roller 61 press-contacts the convey roller 60 from below.

The convey roller 60 and the pinch roller 61 nip the sheet conveyed in the first conveying direction along the curved path 77. When the convey roller 60 rotates in a forward direction, the sheet is conveyed along the platen 42. When the convey roller 60 rotates in a reverse direction, the sheet is conveyed in a direction opposite to the first conveying direction.

A discharge roller 62 and a spur (not shown) are disposed downstream from the recording unit 24, along the first conveying path 23. The discharge roller 62 and the spur nip the sheet having an image recorded thereon and convey the sheet further downstream toward the discharge tray 21.

The convey roller 60 and the discharge roller 62 are driven synchronously by a line feed motor 71, which may be a DC motor. The convey roller 60 and the discharge roller 62 are driven intermittently during image recording such that an image is recorded on the sheet while the sheet is conveyed intermittently by a predetermined line feed width.

A rotary encoder 87 is attached to the convey roller 60. An optical sensor of the rotary encoder 87 detects a pattern of an encoder disc which rotates with the convey roller 60. Based on a signal output by the optical sensor, the controller 84 determines the rotation amounts of the convey roller 60 and the discharge roller 62, and controls the rotation of these rollers 60, 62.

A registration sensor 102 is disposed upstream from the convey roller 60, along the curved path 77 and comprises a pivot member 103 and an optical sensor, e.g., a photo-interrupter. The pivot member 103 is biased to project from the outer guide 18 into the curved path 77 so as to cross the curved path 77. When the sheet conveyed along the curved path 77 contacts the pivot member 23, the pivot member 23 pivots and retracts into the outer guide 18. The optical sensor turns on and off by the projection and retraction of the pivot member 103. The controller 84 determines the positions of a leading edge and a trailing edge of the sheet in the first conveying path 23 based on a signal from the optical sensor.

One end of the reverse path 16 overlaps the discharging path 78 and the other end thereof overlaps the feed tray 20. More specifically, the reverse path 16 branches from a downstream portion 36 of the discharging path 78 and extends obliquely over the feed tray 20 to an upstream portion 37 of the first conveying path 23. The sheet is guided from the discharging path 78 via the branch port 75 to the reverse path 16. The guide member 34 and a switchback roller 45, which is described later, define the branch port 75. The sheet having an image recorded on the first side (front side) thereof is guided, along the reverse path 16, back to the upstream portion 37 of the first conveying path 23.

The reverse path 16 is defined by a first guide surface 32 and a second guide surface 33. The guide member 34 disposed inside the main body frame 53 of the multi-function device 10 has the first guide surface 32. The guide member 34 is disposed downstream from the recording unit 24 in the first conveying direction and adjacent to the branch port 75. The guide member 34 also has a lower guide surface 43 which partially defines the discharging path 78. The sheet passing the recording unit 24 is discharged by the discharge roller 62 and the spur while being held by the lower guide surface 43.

The second guide surface 33 includes a surface of the guide member 35 disposed inside the main body frame 53 and a surface of the flap 17. The guide member 34 opposes the guide member 35 and the flap 17 with a predetermined interval left therebetween. The first guide surface 32 and the second guide surface 33 extend obliquely downward from the downstream portion 36 of the first conveying path 23 toward the feed roller 25.

In another embodiment, the sheet may be conveyed from the downstream portion 36 to the upstream portion 37 while bypassing the recording unit 24, along a path other than the reverse path 16. A different path than the reverse path 16 may be used as long as the path overlaps the downstream portion 37 and the upstream portion 37 of the first conveying path 23.

The flap 17 is supported by a shaft 115 disposed at an end of the discharge tray 21 such that the flap 17 pivots about the shaft 115. The flap 17 comprises a projecting portion 117 that projects obliquely downward toward the bottom plate 113 of the feed tray 20. The projecting portion 117 is positioned at substantially a centered portion in a widthwise direction of the feed tray 20, i.e., a direction perpendicular to a sheet plane of FIG. 3). The projecting portion 117 reaches the bottom plate 113 when there is no sheet in the feed tray 20.

The path switching unit 41 is disposed downstream from the recording unit 24 and specifically at the branch port 75 where the reverse path 16 branch off the discharging path 78. The path switching unit 41 comprises the switchback roller 45, which functions as a third convey roller, a follower roller 46, and an auxiliary roller 47 disposed in parallel with the follower roller 46.

The switchback roller 45 and the follower roller 46 nip the sheet conveyed by the discharge roller 62. The switchback roller 45 is connected to the line feed motor 71 (FIG. 5) via a transmitting mechanism and is driven by the line feed motor 71. A shaft 52 of the switchback roller 45 is supported by the main body frame 53. When the switchback roller 45 rotates in a forward direction, the sheet passing the recording unit 24 is conveyed downstream along the discharging path 78 to the discharge tray 21. When the switchback roller 45 rotates in a reverse direction, the sheet is switchbacked from the discharging path 78 and is conveyed along the reverse path 16.

The follower roller 46 and the auxiliary roller 47 are attached to a frame 48. The frame 48 extends along the discharging path 78 and is configured to pivot about the shaft 52 of the switchback roller 45. This allows the path switching unit 41 to pivot between a discharging position shown in FIG. 4A and a reversing position shown in FIG. 4B. When the path switching unit pivots to the discharging position, the auxiliary roller 47 moves upward to allow the sheet conveyed by the discharge roller 62 to pass between the switchback roller 45 and the follower roller 46. When the path switching unit 41 pivots to the reversing position, the auxiliary roller 47 moves into the branch port 75 and presses the sheet. Then, when the sheet is switchbacked, the second edge of the sheet, i.e., a trailing edge of the sheet having conveyed along the first conveying path 23, is directed to the reverse path 16 as a leading edge of the sheet. The path switching unit 41 changes its position by being driven by the line feed motor 71 via a driving mechanism.

The follower roller 46 is rotatably supported by a shaft 50, and the auxiliary roller 47 is rotatably supported by a shaft 51. The auxiliary roller 47 is separated from the follower roller 46 by a predetermined distance. The follower roller 46 and the auxiliary roller 47 have a spur shape. The follower roller 46 is in contact with the switchback roller 45 from above and is driven by the switchback roller 45. The follower roller 46 is supported by a suspension including a coil spring such that the follower roller 46 is elastically pressed against the switchback roller 45.

The switchback roller 45 is driven by the line feed motor 71 and rotates in forward and reverse directions. The sheet conveyed from the recording unit 24 along the discharging path 78 is nipped by the switchback roller 45 and the follower roller 46. The outer diameter of the switchback roller 45 may be set to be slightly greater than the outer diameter of the discharge roller 62. In this case, when the switchback roller 45 and the discharge roller 62 are driven at the same rotation speed, the circumferential speed of the switchback roller 45 becomes greater than the circumferential speed of the discharge roller 62. Accordingly, the sheet, when conveyed by the discharge roller 62 and the switchback roller 45, is constantly pulled in the first conveying direction.

When the switchback roller 45 rotates in the forward direction, the path switching unit 41 remains in the discharging position so that the sheet passing the recording unit 24 is conveyed toward the discharge tray 21. In the single-sided recording mode, the switchback roller 45 continuously rotates in the forward direction, and the sheet is conveyed downstream in the first conveying direction while being nipped by the switchback roller 45 and the follower roller 46, and is discharged onto the discharge tray 21.

In the double-sided recording mode, the sheet having an image recorded on the first side (front side) of the sheet is conveyed downstream along the first conveying path 23 by the switchback roller 45 and the follower roller 46 and is stopped when the second edge of the sheet, i.e. a trailing edge of the sheet, leaves the lower guide surface 43 and is positioned above the branch port 75. At this time, the path switching unit 41 is in the discharging position.

Consequently, the path switching unit 41 pivots and changes into the reversing position. The second edge of the sheet is bent downward and directed toward the reverse path 16. In this state, when the switchback roller 45 rotates in the reverse direction, the sheet is conveyed in a second conveying direction as the second edge of the sheet as a leading edge. The sheet is switchbacked and conveyed along the reverse path 16 to the feed roller 25. The switchback roller 45 rotating in the reverse direction functions as a return unit for returning the sheet passing the recording unit 24 back to the feed tray 20.

In this embodiment, the sheet feed motor 74 for driving the feed roller 25 is controlled separately and independently from the line feed motor 71 for driving the convey roller 60, discharge roller 62, and switchback roller 45. When the switchback roller 45 rotates in the forward direction, the drive force of the sheet feed motor 74 is transmitted to the feed roller 25, and when the switchback roller rotates in the reverse direction, the drive force of the sheet feed motor 74 is not transmitted to the feed roller 25. Thus, the feed roller 25 does not rotate when the sheet is conveyed by the switchback roller 45 along the reverse path 16. In another embodiment, the feed roller 25 and other rollers, such as the convey roller 61, discharge roller 62, and switchback roller 45, may be driven by a common motor, and the above-described control may be implemented using a drive transmitting/switching mechanism, e.g., a clutch and gears.

The controller 84 may control all the operations of the multi-function device 10. However, descriptions of control of the scanner 12 and the recording unit 24 are omitted herein.

Figure 5:
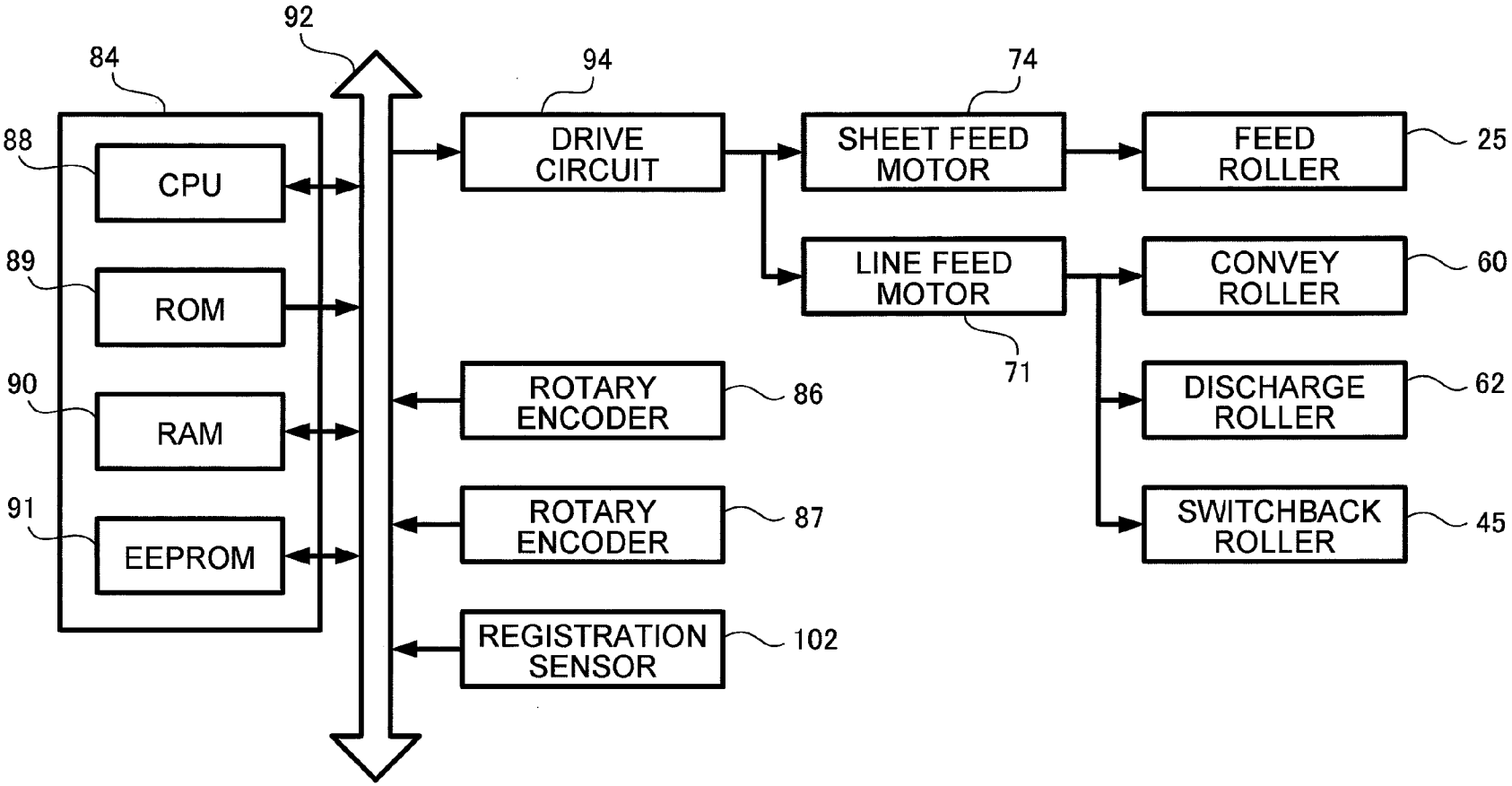
FIG. 5 is a block diagram showing a configuration of a controller of the image recording apparatus of FIG. 1, according to an embodiment of the invention.

As shown in FIG. 5, the controller 84, e.g., a microcomputer, comprises a CPU (central processing unit) 88, a ROM (read only memory) 89, a RAM (random access memory) 90, an EEPROM (electrically erasable programmable ROM) 91, and is connected to each part via a bus.

Figure 6:
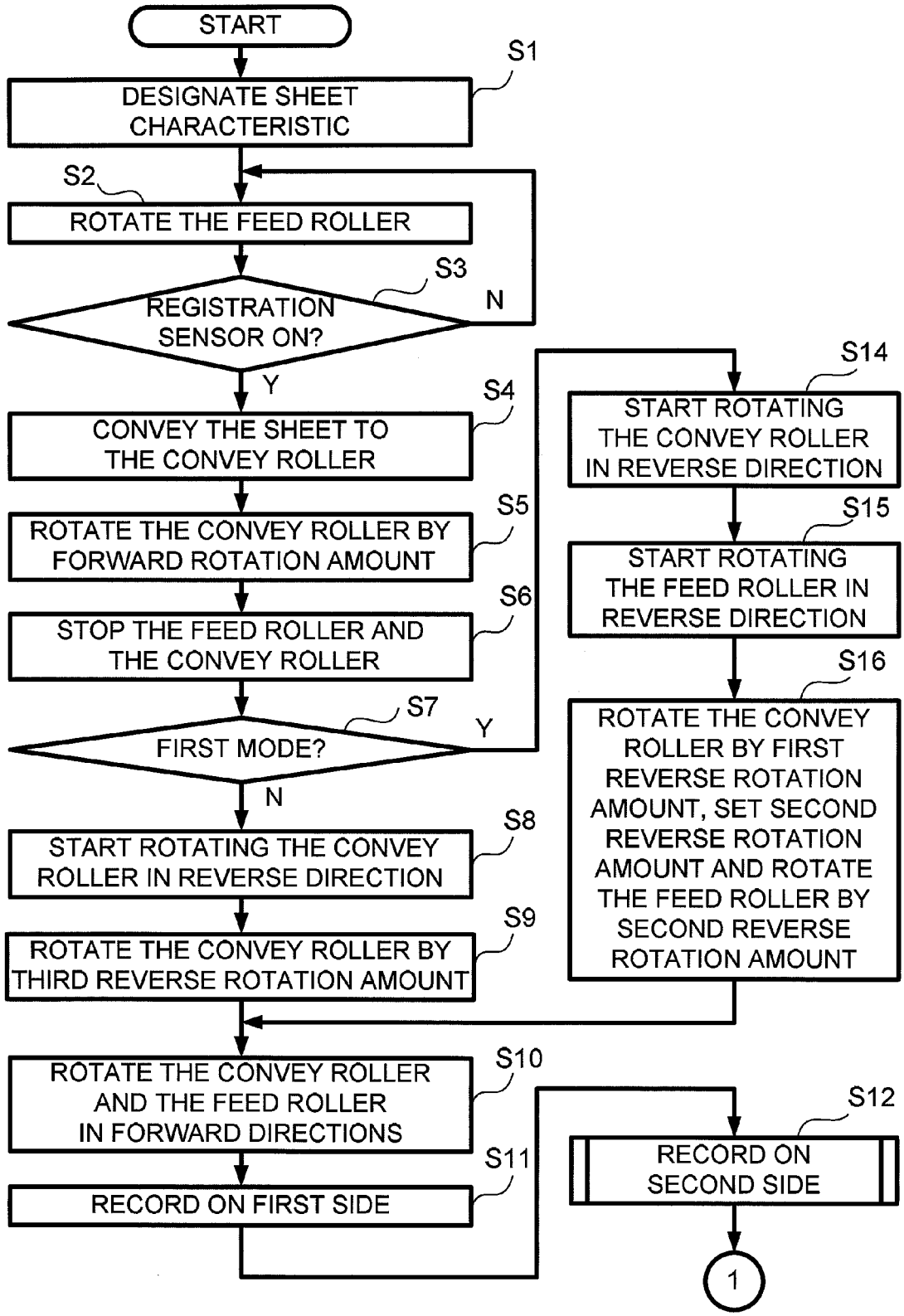
FIG. 6 is a flowchart showing a sheet conveying procedure in the image recording apparatus of FIG. 1, according to an embodiment of the invention.
Figure 7:
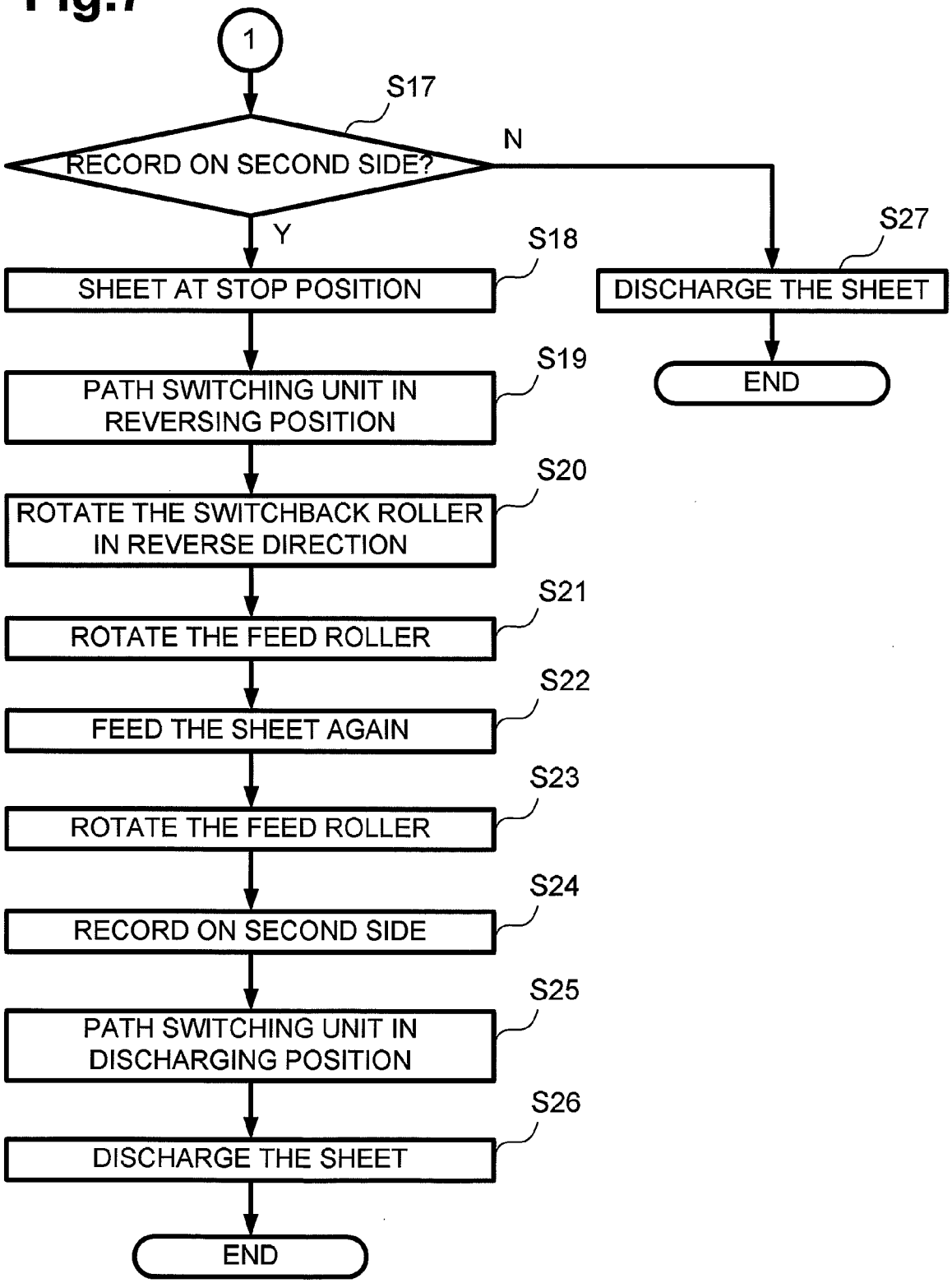
FIG. 7 is a flowchart showing a sheet conveying procedure in the image recording apparatus of FIG. 1, according to an embodiment of the invention.

The ROM 89 stores programs for controlling operations of the multi-function device 10, e.g., programs for executing steps of the flowcharts shown in FIGS. 6 and 7.

The RAM 90 is a memory area or a work area in which various data is temporarily recorded to be used by the CPU 88 that executes the programs stored in the ROM 89. Specifically, a characteristic of a sheet, e.g., type (plain paper, postcard, etc.), size, thickness, stiffness, and surface roughness of a sheet, designated from the operation panel 40 or the like is stored in the RAM 90.

The EEPROM 91 stores data, settings, and flags to be maintained after the power is turned off.

The drive circuit 94 drives the line feed motor 71 connected to the convey roller 60, discharge roller 62, and switchback roller 45, and the sheet feed motor 74 connected to the sheet feed roller 25. The drive circuit 94 comprises a driver for driving the line feed motor 71 and a driver for driving the sheet feed motor 74 in order to drive the line feed motor 71 and the sheet feed motor 74 separately. The drive circuit 94 receives phase energizing signals from the CPU 88 and generates electrical signals to the line feed motor 71 and the sheet feed motor 7, which in turn rotate. The rotation force of the line feed motor 71 is transmitted via a drive mechanism, e.g., gears and drive shafts, to the feed roller 25. The rotation force of the sheet feed motor 74 is transmitted via a drive mechanism, e.g., gears and drive shafts, to the convey roller 60, discharge roller 62, and switchback roller 45.

The registration sensor 102 and the rotary encoders 86, 87 are connected to the bus 92. As already described, the registration sensor detects the first edge of the sheet, i.e., a leading edge of the sheet subjected to recording on a first side (front side), and the second edge of the sheet, i.e., a leading edge of the sheet subjected to recording on a second side (back side). The rotary encoder 87 detects a rotation amount of the convey roller 60 driven by the line feed motor 71. The rotary encoder 86 detects a rotation amount of the feed roller 25 driven by the sheet feed motor 74. The controller 84 determines the positions of the first edge and the second edge of the sheet and the conveying amount of the sheet, based on a signal from the registration sensor and the rotation amounts detected by the rotary encoders 86, 87.

One example of a sheet conveying procedure executed by the controller 84 when the printer 11 of the multi-function device 10 performs image recording will be described with reference to the flowcharts in FIGS. 6 and 7.

In step S1, a characteristic of a sheet, e.g., type (plain paper, postcard, etc.), size, thickness, stiffness, and surface roughness of a sheet, on which an image is recorded, is designated from the operation panel 40 or a computer connected to the multi-functional device 10. The designated characteristic of the sheet is stored in the RAM 90. At this time, a recording mode, i.e., a single-sided recording mode or a double-sided recording mode, may be designated, as well. In step S2, the CPU 88 of the controller 84 controls the drive circuit 94 to drive the sheet feed motor 74 such that the feed roller 25 rotates in a forward direction. The feed roller 25 conveys the sheet along the first conveying path 23 with a first edge of the sheet as a leading edge. When the sheet is conveyed along the curved path 77, the sheet is flipped over such that a side opposite to a side contacted by the feed roller 25 opposes the nozzle face. The sheet is conveyed in the first conveying direction.

After the sheet passes the registration sensor 102 in step S3, i.e., after the registration sensor turns on in step S3, the CPU 88 controls, in step S4, the feed roller 25 to rotate in the forward direction until the first edge of the sheet reaches the convey roller 60. The CPU 88 determines whether the first edge of the sheet has reached the convey roller 60, based on a rotation amount detected by the rotary encoder 86 after the registration sensor turns on. When the first edge of the sheet reaches the convey roller 60, the CPU 88 drives, in step S5, the line feed motor 71 to rotate the convey roller 60 in a forward direction by a predetermined forward rotation amount such that the sheet passes through a nip of the convey roller 60. When the CPU 88 determines that the convey roller 60 has rotated by the predetermined forward rotation amount, based on a rotation amount detected by the rotary encoder 87, the CPU 88 stops the feed roller 25 and the convey roller 60 in step S6.

In step S7, the CPU 88 determines whether to perform sheet registration in a first mode according to the characteristic of the sheet designated in step S1. The CPU 88 may make this determination by checking, in a table stored in the ROM 89, whether a first mode is set for the designated characteristic of the sheet, which is stored in the RAM 90.

When the CPU 88 determines negatively (No) in step S7, i.e., determines that a second mode for sheet registration is set for the designated characteristic of the sheet, the CPU 88 drives, in step S8, the line feed motor 71 to start rotating the convey roller 60 in a reverse direction while the feed roller 25 is stopped. In step S9, the CPU 88 rotates the convey roller 60 in the reverse direction by a predetermined reverse rotation amount (a third reverse rotation amount) such that the sheet is released from the nip of the convey roller 60. The predetermined reverse rotation amount of the convey roller 60 may be set to be equal to or slightly greater than the predetermined forward rotation amount of the convey roller 60 in step S5. The CPU 88 determines whether the convey roller 60 has rotated by the first reverse rotation amount, based on a rotation amount detected by the rotary encoder 87.

At this time, because the feed roller 25 is stopped, the sheet released from the nip of the convey roller 60 is bent elastically in the first conveying path 23. The first edge of the sheet is pressed against the nip of the convey roller 60 due to a resilient force of the sheet. This aligns the first edge of the sheet with respect to the convey roller 60 and thereby corrects or reduces skewing of the sheet.

When the CPU 88 determines affirmatively (Yes) in step S7, i.e., determines that a first mode for sheet registration is set for the designated characteristic of the sheet, the CPU 88 drives the line feed motor 71 to start rotating the convey roller 60 in a reverse direction in step S14. In response to the rotation of the convey roller 60 in the reverse direction, the CPU 88 drives the sheet feed motor 74 to start rotating the feed roller 25 in a reverse direction in step S15. In step S16, the CPU 88 keeps rotating the covey roller 60 in the reverse direction by a first reverse rotation amount corresponding to a first linear distance such that the sheet is released from the nip of the convey roller 60. The first reverse rotation amount of the convey roller 60 may be set to be equal to or slightly greater than the predetermined forward rotation amount of the convey roller 60 in step S5. In step S16, the CPU 88 keeps rotating the feed roller 25 in a reverse direction by a second reverse rotation amount corresponding to a second linear distance to convey a second edge of the sheet reversely. The CPU 88 sets the second reverse rotation amount based on the designated characteristic of the sheet.

The CPU 88 may set the second reverse rotation amount variably based on the designated characteristic of the sheet. It is preferable that the CPU 88 sets the second reverse rotation amount of the feed roller 25 that corresponds to the second linear distance such that the second linear distance is less than the first linear distance and/or such that the second linear distance is not greater than a distance by which the sheet is conveyed reversely by the conveyor roller 60. In this case, a distance by which the sheet is conveyed reversely by the feed roller 25 is not greater than the distance by which the sheet is conveyed reversely by the convey roller 60. Accordingly, the first edge of the sheet released from the nip of the convey roller 60 is unlikely to be separated from the nip of the convey roller 60. Once the sheet is released from the nip of the convey roller 60 before or when the convey roller 60 has rotated by the first reverse rotation amount, the first edge of the sheet remains contacting the nip due to a resilient force of the sheet.

In step S16, The CPU 88 may set the second reverse rotation amount by calculating it using a program stored in the ROM 89, or by selecting it from a correspondence table between second reverse rotation amounts and characteristic variables of a sheet. The correspondence table may be stored in the ROM 89.

In step S16, when the convey roller 60 has rotated by the first reverse rotation amount and the feed roller 25 has rotated by the second reverse rotation amount, the first edge of the sheet is pressed against and contacts the nip of the convey roller 60. This aligns the first edge of the sheet with respect to the convey roller 60 and thereby corrects or reduces skewing of the sheet. In step S16, even when the sheet has a relatively high resilient force depending on its characteristic, the sheet is likely to be released from the nip of the convey roller 60 because the feed roller 25 rotates in the reverse direction, as well as the convey roller 60. Although the sheet between the convey roller 60 and the feed roller 25 is bent to a less degree, as compared with the sheet in step S9, the sheet, depending on its characteristic, may generate a sufficient resilient force to press the first edge against the nip of the convey roller 60.

Subsequently, in step S10, the CPU 88 drives the sheet feed motor 74 and the line feed motor 71 to rotate the feed roller 25 and the convey roller 60 in forward directions, respectively. In step S11, the sheet is conveyed on the platen 42 along the first conveying path 23, and the recording head 39 records an image on a first side (front side) of the sheet.

In step S12, the CPU 88 determines whether to perform image recording on a second side (back side) of the sheet. When the CPU determines negatively (No) in step S17, i.e., when a single-sided recording mode is set from the operation panel 40 or the like, the sheet having the image recorded on the first side is conveyed downstream along the first conveying path 23 and is discharged in step S27.

When the CPU 88 determines affirmatively (Yes) in step S17, i.e., when a double-sided recording mode is set from the operation panel 40 or the like, the sheet having the image recorded on the first side is conveyed downstream. In step S18, when the second edge (trailing edge) of the sheet leaves the lower guide surface 43 and reaches a stop position right above the branch port 75 formed between the first conveying path 23 and the reverse path 16, the switchback roller 45 is stopped. The CPU 88 determines whether the second edge of the sheet reaches the stop position, based on a rotation amount detected by the rotary encoder 87.

In step S19, the path switching unit 41 pivots about the shaft 52 of the switchback roller 45 and changes from the discharging position to the reversing position while the sheet is stopped. The auxiliary roller 47 presses the second edge of the sheet toward the reverse path 16 such that the sheet enters the reverse path 16.

In step S20, the CPU 88 drives the line feed motor 71 to rotate the switchback roller 45 in the reverse direction. The sheet is switchbacked and conveyed along the reverse path 16 to the feed roller 25. When the sheet reaches the feed roller 25, the CPU 88 rotate the feed roller 25 in step S21 to feed the sheet again toward the recording unit 24 in step S22.

In step S23, the CPU 88 rotate the feed roller 25 to convey the sheet along the first conveying path 23. The sheet is flipped over along the first conveying path 23, and image recording on the second side (back side) of the sheet is performed in step S24. In step S24, the sheet is conveyed for recording on the second side in the same manner as when the sheet is conveyed for recording on the first side. The sheet is conveyed to perform sheet registration in the first mode as in S3-S7 and S14-S16 or in the second mode as in S3-S9 in FIG. 6. Subsequently, the CPU 88 rotates the feed roller 25 and the convey roller 60 in forward directions as in step S10, and the recording head 39 records an image on the second side of the sheet conveyed along the platen 42.

Figure 8:
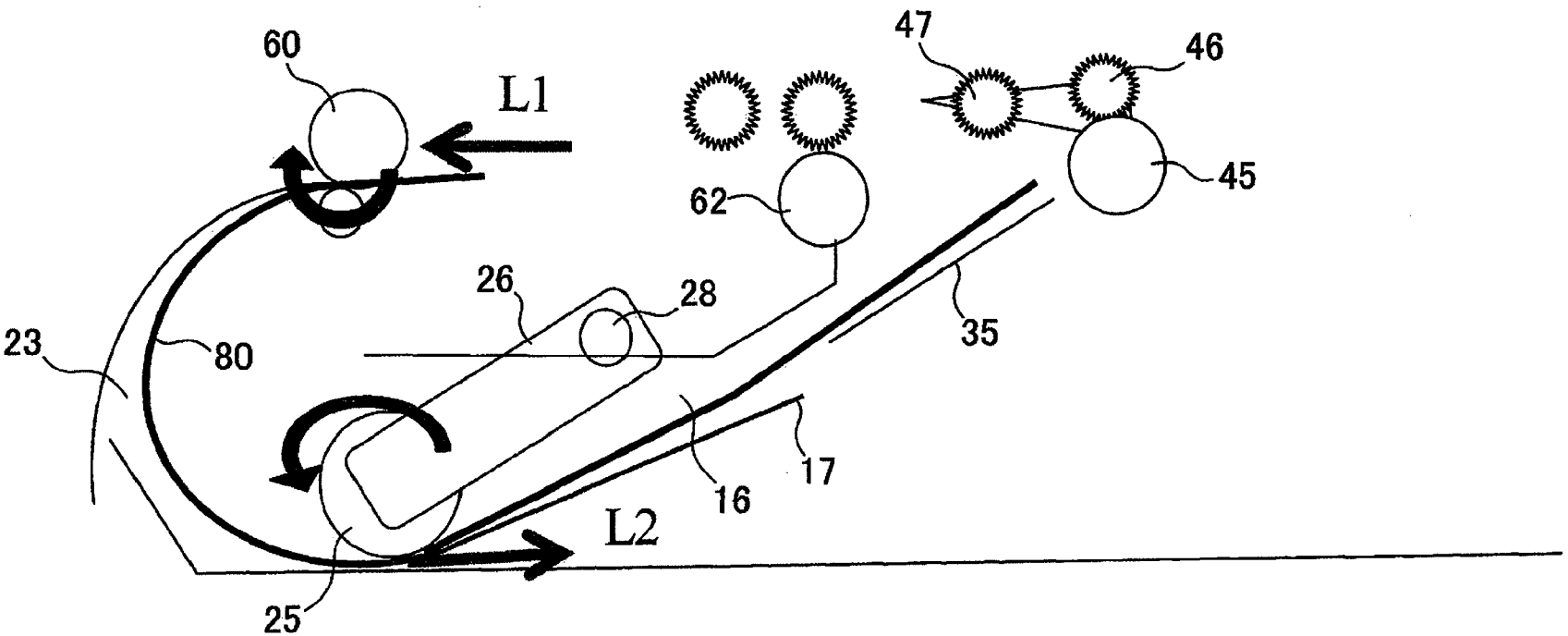
FIG. 8 is a schematic drawing showing conveyance of a sheet in a double-sided recording mode.

FIG. 8 schematically shows a sheet 80 switchbacked and conveyed for recording on the second side. In the same manner as for recording on the first side, when the CPU 88 determines affirmatively (Yes) in step S7, i.e., determines that the first sheet registration mode is set for the characteristic of the sheet designated in step 1, the CPU 88 starts rotating the convey roller 60 in a reverse direction in step S14. In response to the rotation of the convey roller 60 in the reverse direction, the CPU 88 starts rotating the feed roller 25 in a reverse direction in step S15. In step S16, the CPU 88 keeps rotating the covey roller 60 in the reverse direction by a first reverse rotation amount corresponding to a first linear distance such that the sheet is released from the nip of the convey roller 60. The first reverse rotation amount of the convey roller 60 may be set to be equal to or slightly greater than the predetermined forward rotation amount of the convey roller 60 in step S5. In step S16, the CPU 88 rotates the feed roller 25 in a reverse direction by a second reverse rotation amount corresponding to a second linear distance to convey the sheet reversely. The CPU 88 sets the second reverse rotation amount based on the designated characteristic of the sheet.

In step S16, The CPU 88 may set the second reverse rotation amount variably based on the designated characteristic of the sheet. It is preferable that the CPU 88 sets the second reverse rotation amount of the feed roller 25 that corresponds to the second linear distance such that the second linear distance is less than the first linear distance and/or such that the second linear distance is not greater than a distance L1 by which the sheet is conveyed reversely by the convey roller 60. In this case, a distance L2 by which the sheet is conveyed reversely by the feed roller 25 is not greater than the distance L1. Accordingly, the leading edge of the sheet released from the nip of the convey roller 60 is unlikely to be separated from the nip of the convey roller 60.

In step S16, when the convey roller 60 has rotated by the first reverse rotation amount and the feed roller 25 has rotated by the second reverse rotation amount, the second edge (a leading edge for second side recording) of the sheet is pressed against and contacts the nip of the convey roller 60. This aligns the leading edge of the sheet with respect to the convey roller 60 and thereby corrects or reduces skewing of the sheet.

When the recording head 39 has recorded the image on the second side of the sheet in step S24, the CPU 88 rotates the discharge roller 62 to convey the sheet downstream along the first conveying path 23. The path switching unit 41 changes into the discharging position in step S25 to convey the sheet onto the discharge tray 21 in step S26.

In the above described embodiment, sheet registration is performed in the first mode or the second mode, according to a characteristic of the sheet before the recording unit 24 records an image on the sheet. In the first mode, the convey roller 60 and the feed roller 25 are rotated reversely, and the reverse rotation amount of the feed roller 25 is set based on the characteristic of the sheet. In the second registration mode, the convey roller 60 is rotated reversely while the feed roller 25 is stopped. In either mode, the leading edge is released from the nip of the convey roller in a stable manner, and the sheet is bent between the feed roller 25 and the convey roller 60 such that the leading edge is pressed against the nip of the convey roller 60. Further, in the first registration mode, the degree of bending of the sheet between the feed roller 25 and the convey roller 60 is suitably adjusted by the variable setting of the reverse rotation amount of the feed roller 25. Accordingly, the sheet is aligned and deskewed stably before image recording thereon.

In another embodiment of the invention, a suitable sheet registration mode may be selected from the first mode and the second mode, depending on whether recording is performed on a first side (front side) or on a second side (back side) in a double-sided recording mode, because the condition of the sheet, e.g., a deformed degree of the sheet, changes after the recording on the first side.

In another embodiment of the invention, a suitable sheet registration mode may be selected from the first mode and the second mode, depending on ambient factors, e.g., humidity, around a sheet conveying device. Further, the reverse rotation amount of the feed roller 25 in the second mode may be variably set depending on ambient factor values.

Although the above-described sheet registration is performed in the sheet conveying device for use in the printer 11, the above-described sheet registration may be performed in a sheet conveying device for use in a scanner.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A sheet conveying device comprising:

a first convey roller disposed in a first path;

a second convey roller disposed in the first path and downstream from the first convey roller in a sheet conveying direction;

a driving unit configured to independently drive each of the first convey roller and the second convey roller; and a controller configured to control the driving unit in a particular mode, such that:

the first convey roller rotates in a forward direction to convey a sheet along the first path in the sheet conveying direction, the second convey roller rotates in a forward direction to convey the sheet along the first path in the sheet conveying direction, wherein the first convey roller conveys the sheet such that a leading edge of the sheet passes through a nip of the second convey roller, the second convey roller rotates in a reverse direction by a first rotation amount corresponding to a first linear distance to convey the sheet in a direction opposite to the sheet conveying direction, such that the leading edge of the sheet is released from the nip of the second convey roller, and in response to the rotation of the second convey roller in the reverse direction, the first convey roller rotates by a second rotation amount corresponding to a second linear distance in the reverse direction to convey the sheet in the direction opposite to the sheet conveying direction, such that the leading edge of the sheet contacts the nip of the second convey roller when the first convey roller has rotated by the second rotation amount and the second convey roller has rotated by the first rotation amount.

2. The sheet conveying device according to claim 1, wherein the controller is configured to control the driving unit in a further mode, such that:

the first convey roller rotates in the forward direction to convey the sheet along the first path in the sheet conveying direction, the second convey roller rotates in the forward direction to convey the sheet along the first path in the sheet conveying direction, wherein the first convey roller conveys the sheet such that the leading edge of the sheet passes through the nip of the second convey roller, the second convey roller rotates by a third rotation amount in the reverse direction to convey the sheet in the direction opposite to the sheet conveying direction such that the leading edge of the sheet is released from the nip of the second convey roller, and the first convey roller does not rotate in the reverse direction in response to the rotation of the second convey roller in the reverse direction.

3. The sheet conveying device according to claim 2, wherein the controller is configured to control the driving unit such that, when in the further mode, the first convey roller stops rotating in response to the rotation of the second convey roller in the reverse direction.

4. The sheet conveying device according to claim 2, wherein the controller is configured to select one of the particular mode and the further mode based on at least a characteristic of the sheet.

5. The sheet conveying device according to claim 1, wherein the second linear distance is less than the first linear distance.

6. The sheet conveying device according to claim 5, wherein the controller is configured to vary the second rotation amount corresponding to the second linear distance based on at least a characteristic of the sheet.

7. The sheet conveying device according to claim 1, wherein the first path comprises a curved portion disposed between the first convey roller and the second convey roller, and the sheet is conveyed in the curved portion.

8. The sheet conveying device according to claim 1, wherein the driving unit comprises at least one DC motor for driving the first convey roller and the second convey roller, and the sheet conveying device further comprises:

a sheet detecting unit configured to detect the leading edge of the sheet conveyed in the first path;

a rotation amount detecting unit configured to detect a rotation amount of the first convey roller and a rotation amount of the second convey roller, wherein the controller determines a position of the sheet based on the leading edge detected by the sheet detecting unit and the rotation amounts detected by the rotation amount detecting unit.

9. The sheet conveying device according to claim 1, further comprising a feed tray configured to hold a stack of sheets therein, wherein the first convey roller is urged toward the feed tray.

10. The sheet conveying device according to claim 1, further comprising a sheet return unit disposed downstream from the second convey roller in the sheet conveying direction and configured to return the sheet along a second path back to the first convey roller after the sheet passes the second convey roller, wherein the controller is configured to control the driving unit in the particular mode, such that:

the first convey roller rotates in the forward direction to convey the returned sheet along the first path in the sheet conveying direction, the second convey roller rotates in the forward direction to convey the returned sheet along the first path in the sheet conveying direction, wherein the first convey roller conveys the returned sheet such that a leading edge of the returned sheet passes through the nip of the second convey roller, the second convey roller rotates in the reverse direction by the first rotation amount corresponding to the first linear distance to convey the returned sheet in the direction opposite to the sheet conveying direction, such that the leading edge of the returned sheet is released from the nip of the second convey roller, and in response to the rotation of the second convey roller in the reverse direction, the first convey roller rotates by the second rotation amount corresponding to the second linear distance in the reverse direction to convey the returned sheet in the direction opposite to the sheet conveying direction, such that the leading edge of the returned sheet contacts the nip of the second convey roller when the first convey roller has rotated by the second rotation amount and the second convey roller has rotated by the first rotation amount.

11. The sheet conveying device according to claim 10, wherein the sheet return unit comprises a third convey roller configured to rotate in a forward direction to convey the sheet along the first path in the sheet conveying direction, and configured to rotate in a reverse direction to convey the sheet back to the first convey roller along the second path.

12. The sheet conveying device according to claim 10, wherein the leading edge of the sheet before the sheet is returned by the sheet return unit and the leading edge of the returned sheet are opposing edges of the sheet in the sheet conveying direction.

13. An image recording apparatus comprising:

a recording unit configured to record an image on a sheet conveyed along a first path in a sheet conveying direction;

a first convey roller disposed in the first path;

a second convey roller disposed in the first path and downstream from the first convey roller and upstream from the recording unit in the sheet conveying direction;

a driving unit configured to independently drive each of the first convey roller and the second convey roller; and a controller configured to control the driving unit in a particular mode such that:

the first convey roller rotates in a forward direction to convey a sheet along the first path in the sheet conveying direction, the second convey roller rotates in a forward direction to convey the sheet along the first path in the sheet conveying direction, wherein the first convey roller conveys the sheet such that a leading edge of the sheet passes through a nip of the second convey roller, the second convey roller rotates in a reverse direction by a first rotation amount corresponding to a first linear distance to convey the sheet in a direction opposite to the sheet conveying direction, such that the leading edge of the sheet is released from the nip of the second convey roller, and in response to the rotation of the second convey roller in the reverse direction, the first convey roller rotates by a second rotation amount corresponding to a second linear distance to convey the sheet in the reverse direction opposite to the sheet conveying direction, such that the leading edge of the sheet contacts the nip of the second convey roller when the first convey roller has rotated by the second rotation amount and the second convey roller has rotated by the first rotation amount.

14. A sheet conveying device comprising:

a first convey roller disposed in a first path;

a second convey roller disposed in the first path and downstream from the first convey roller in a sheet conveying direction;

means for independently driving each of the first convey roller and the second convey roller;

means for controlling the driving means for independently driving the first convey roller and the second convey roller such that:

the first convey roller rotates in a forward direction to convey a sheet along the first path in the sheet conveying direction;

the second convey roller rotates in a forward direction to convey the sheet along the first path in the sheet conveying direction, wherein the first convey roller conveys the sheet such that a leading edge of the sheet passes through a nip of the second convey roller;

the second convey roller rotates in a reverse direction by a first rotation amount corresponding to a first linear distance to convey the sheet in a direction opposite to the sheet conveying direction, such that the leading edge of the sheet is released from the nip of the second convey roller; and in response to the rotation of the second convey roller in the reverse direction, the first convey roller rotates by a second rotation amount corresponding to a second linear distance in the reverse direction to convey the sheet in the direction opposite to the sheet conveying direction, such that the leading edge of the sheet contacts the nip of the second convey roller when the first convey roller has rotated by the second rotation amount and the second convey roller has rotated by the first rotation amount.

* * * * *